US005816931A

United States Patent [19]

Schooler

[11] Patent Number: 5,816,931

[45] Date of Patent: Oct. 6, 1998

[54] ADJUSTABLE GOLF PUTTER

[76] Inventor: Paul T. Schooler, 16285 Erin, Fraser, Mich. 48026

[21] Appl. No.: 866,978

[22] Filed: Jun. 2, 1997

[51] Int. Cl.[6] ..... A63B 53/02

[52] U.S. Cl. ..... 473/248; 473/307; 473/313; 473/314

[58] Field of Search ..... 473/244, 245, 473/246, 247, 248, 305, 306, 307, 308, 309, 310, 311, 312, 313, 314, 315

[56] References Cited

U.S. PATENT DOCUMENTS

| | | | |
|---|---|---|---|
| 9,169 | 1/1852 | Waite . | |
| 749,174 | 1/1904 | Davis | 473/246 |
| 1,352,020 | 9/1920 | Olson | 473/246 |
| 1,515,998 | 11/1924 | Clark . | |
| 1,643,250 | 9/1927 | Longsworth | 473/248 |
| 3,214,170 | 10/1965 | Warnock | 473/248 |
| 3,610,630 | 10/1971 | Glover . | |
| 3,909,005 | 9/1975 | Piszel | 473/248 |
| 4,073,492 | 2/1978 | Taylor | 473/246 |
| 4,111,426 | 9/1978 | Goodwin . | |
| 4,133,535 | 1/1979 | Marsh . | |
| 4,881,737 | 11/1989 | Mullins . | |
| 5,348,295 | 9/1994 | Phillips . | |
| 5,388,827 | 2/1995 | Reynolds | 473/307 |
| 5,390,920 | 2/1995 | Nickum . | |
| 5,415,399 | 5/1995 | Kettelson . | |
| 5,429,356 | 7/1995 | Dingle et al. . | |
| 5,470,063 | 11/1995 | Fisher . | |
| 5,580,051 | 12/1996 | Fisher . | |
| 5,603,666 | 2/1997 | Bowe | 473/307 |
| 5,692,969 | 12/1997 | Schooler | 473/248 |

*Primary Examiner*—Sebastiano Passaniti
*Attorney, Agent, or Firm*—Howard &Howard

[57] ABSTRACT

Golf clubs are disclosed wherein the angle of the shaft relative to the head is adjustable. In one embodiment, a member extends into a top surface of the head, and the shaft is adjustable with that member relative to the head. A resilient locking member locks the shaft once a desired orientation is achieved. In a second embodiment, the shaft is provided with an inner portion extending into a side of the head. A pin is fixed in an inner portion of the shaft. Threaded locking members lock the pin and hence the shaft once a desired orientation is achieved relative to the head.

4 Claims, 2 Drawing Sheets

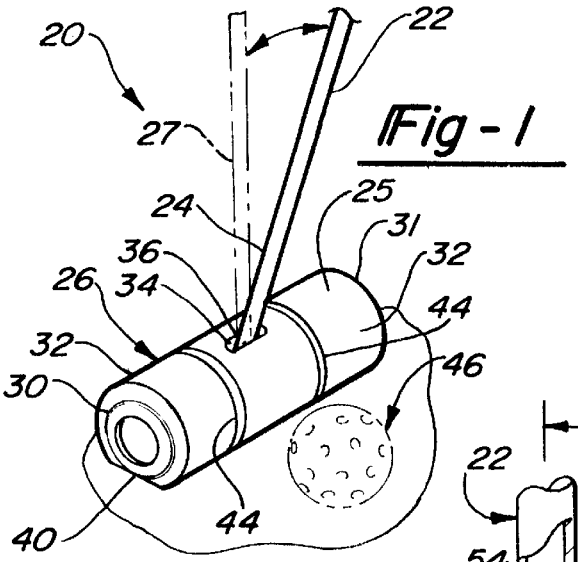
Fig - 1
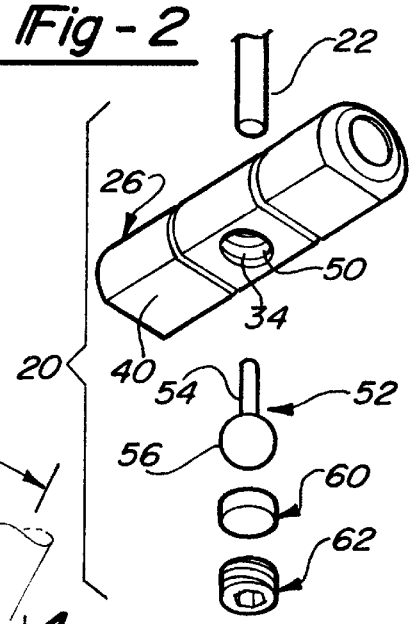
Fig - 2
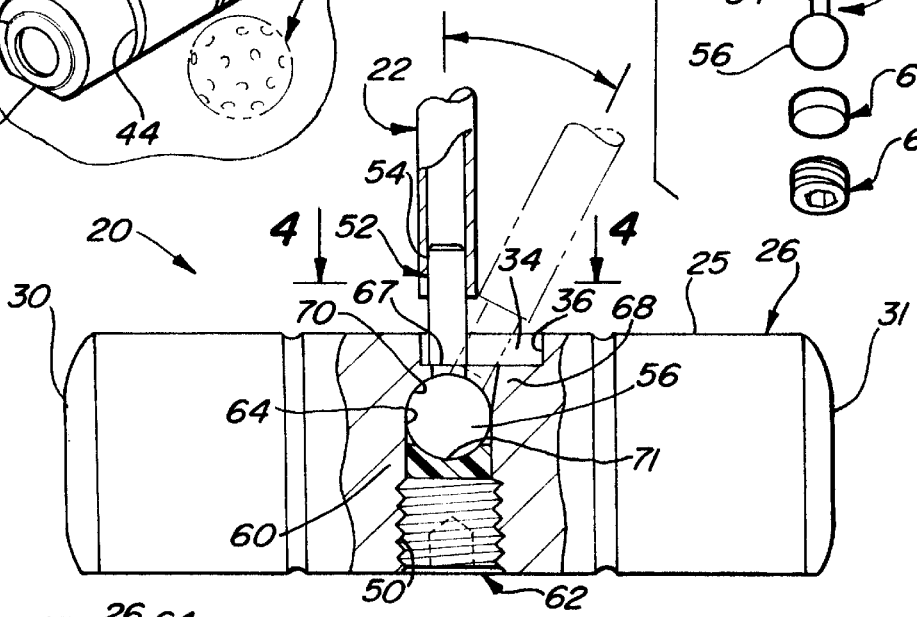
Fig - 3
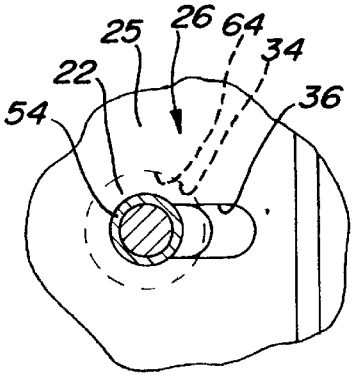
Fig - 4
Fig - 6
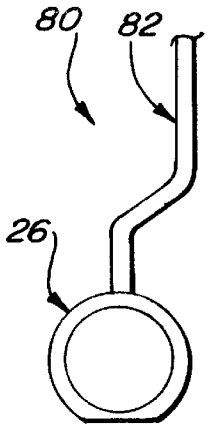
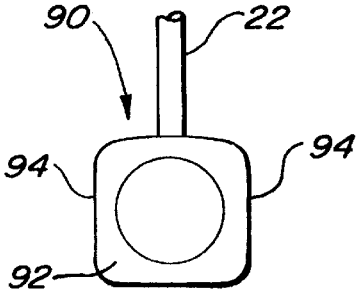
Fig - 5

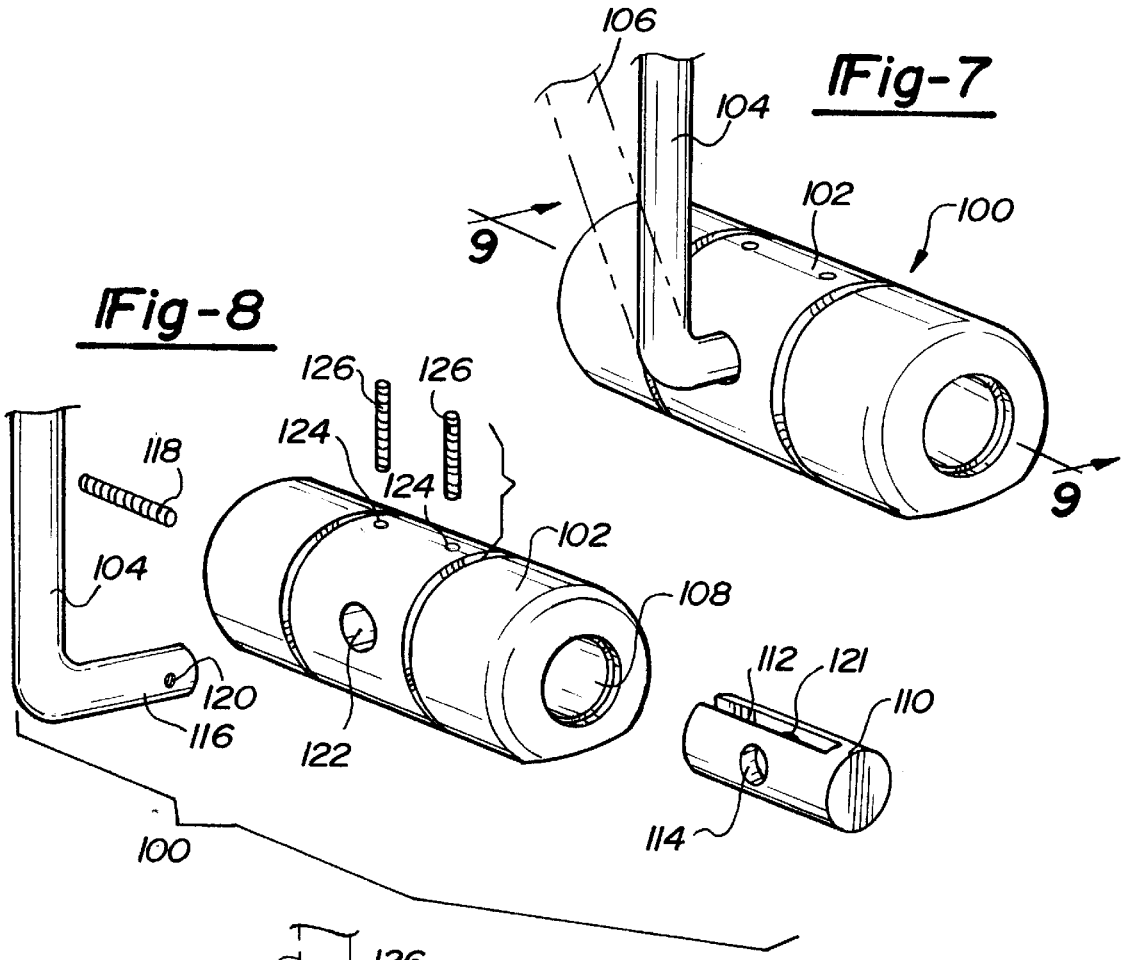
Fig-7
Fig-8
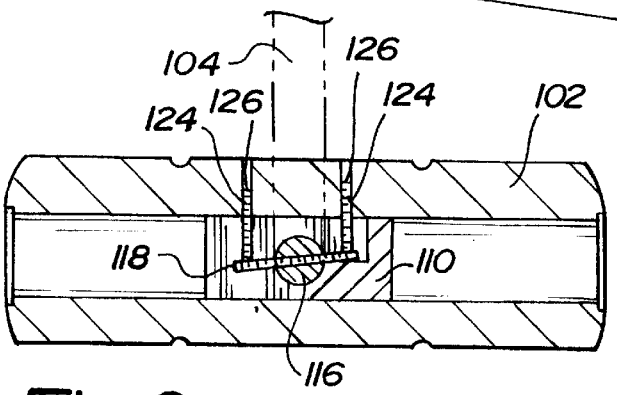
Fig-9
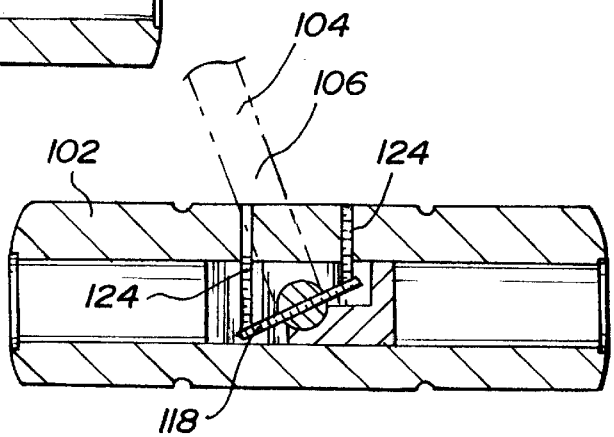
Fig-10

ADJUSTABLE GOLF PUTTER

BACKGROUND OF THE INVENTION

This invention relates to golf putters and more particularly to a golf putter wherein the angle of the head relative to the shaft is adjustable.

Golfers of different styles may prefer that the golf club head be mounted on the shaft of the golf club at different angles, generally between 30 and 90 degrees. Further, a single golfer may wish to vary the golf club head angle for a particular shot or terrain. This is particularly true for putters.

Several known golf clubs have attempted to provide a golf club wherein the angle of the head is adjustable relative to the shaft. One known golf club utilizes a shaft having a lower end terminating in a generally spherical pivot ball. The ball is disposed within a bore in the golf club head and is secured by a locking screw threaded into the bore. However, the pivot ball in the known golf club permits the shaft to rotate and pivot in any direction relative to the golf club head. Consequently, the inadvertent pivotal movement of the shaft about the axis of the golf club head causes the face of the golf club to be tilted undesirably.

Another known golf club utilizes a golf shaft attached to a moveable sphere mounted within a pocket of a top portion of a putter head and seated within a first or second cavity in the bottom portion of the putter head. However, again, the inadvertent pivotal movement of the shaft about the axis of the golf club head causes the face of the golf club head to be tilted undesirably relative to the shaft.

A known golf club having an adjustable head includes a shaft having a hub at a lower end. A threaded bolt extends horizontally from the side of the head opposite the face. The bolt is inserted through the hub on the lower end of the shaft. A nut is threaded onto the bolt to secure the shaft to the head in the desired position. Because the shaft is secured to the side of the head, that side cannot be used to contact the golf ball.

All of the above described prior golf clubs are unduly complex and include many working parts. Moreover, most of these clubs have pivoting structure that enters into the top of the club head and is accessible to dirt, etc. This is undesirable.

SUMMARY OF THE INVENTION

The present invention provides golf putters having a head, the angle of which is adjustable relative to the shaft. The putters also prevent pivotal movement of the shaft about the axis of the head, i.e. the movement of the head relative to the shaft is restricted generally to a single plane which contains both the shaft and the axis of the head.

In the two disclosed embodiments of this invention, a threaded locking member is moved to lock the putter at the adjusted position once the shaft has been rotated relative to the head.

In one embodiment, the inventive putter includes a shaft having a lower end pivotally secured to an upper surface of a head. The head is preferably generally cylindrical, having two convex faces and a flattened lower surface. The convex faces ensure proper line contact with the ball even with some slight tilt of the putter by the golfer. The head includes a bore generally transverse to the upper surface of the head. The bore includes a longitudinally-elongate, narrow upper portion adjacent the upper surface of the head. A rotatable member comprises a stem portion extending from a ball portion. The ball portion of the rotatable member is rotatably disposed within the bore and the stem portion extends through the upper portion of the bore. The stem portion is inserted into the shaft. A threaded locking member selectively locks and unlocks the rotatable member within the head, thereby selectively permitting adjustment of the shaft-head angle. While the locking member holds the shaft at a selected position, a golfer can easily adjust the angle by applying weight. In fact, the angle can be adjusted on the surface of the golf green by applying weight and tailoring the angle to a desired angle. The motion of the shaft is restricted by the upper portion of the bore, the upper portion prevents pivotal movement of the shaft about the axis of the head, which would otherwise cause the face of the head to be tilted relative to the shaft. The upper portion also restricts the pivotal movement of the shaft to between about 30 degrees and 90 degrees relative to the head.

In a second embodiment, the putter shaft has an end mount portion extending through a hole in the side of the putter head. This end portion of the shaft is mounted and received within a guide plug. A pin extends through the inner end of the shaft and pivots within a guide channel in the guide plug. Two threaded locking members can be moved downwardly through the head to fix the pin in the shaft inner end. The threaded locking members are moved to a remote position to allow the shaft position to be adjusted. Once the shaft is in a desired position the threaded locking members are moved downwardly to lock the pin and thus the shaft.

BRIEF DESCRIPTION OF THE DRAWINGS

The above, as well as other advantages of he present invention, will become readily apparent to those skilled in the art form the following detailed description of a preferred embodiment when considered in the light of the accompanying drawings in which:

FIG. 1 is a perspective view of the adjustable putter according to the present invention.

FIG. 2 is an exploded perspective view of the putter of FIG. 1.

FIG. 3 is a side view partially broken away of the putter of FIG. 1.

FIG. 4 is a top view of a portion of the putter of FIG. 3 taken along line 4—4.

FIG. 5 is a front view of an alternative putter of the present invention.

FIG. 6 is a perspective view of another alternative putter of the present invention.

FIG. 7 shows another embodiment putter.

FIG. 8 is an exploded view of the details of the FIG. 7 embodiment.

FIG. 9 shows the putter with a shaft in a first position.

FIG. 10 shows the putter in a second position.

DESCRIPTION OF A PREFERRED EMBODIMENT

An adjustable putter 20 according to the present invention is shown in FIG. 1. The inventive putter 20 includes a shaft 22 having a lower end 24 pivotally secured to an upper surface 25 of a head 26. The angle of the shaft 22 relative to the head 26 is selectively adjustable, generally up to a perpendicular position 27 (shown in phantom) perpendicular to the axis of the head 26.

The head 26 is preferably generally cylindrical having longitudinal ends 30, 31 and convex faces 32. The head 26 includes a bore 34 generally transverse to the upper surface 25 of the head 26. The bore 34 includes a longitudinally-elongated upper portion 36 adjacent the upper surface 25 of the head 26. The lower surface 40 of the head 26 is preferably flattened.

The putter 20 preferably includes a pair of guidelines 44 about the circumference of the head 26 generally representing one-third markers of the longitudinal length of the head 26. The guidelines 44 assist the golfer in properly hitting the golf ball 46 at the center of gravity of the head 26. The head 26 is preferably Delrin 500 CL, aluminum or other suitable material.

As can be seen in FIG. 2, the bore 34 in the head 26 includes a threaded portion 50 adjacent the lower surface 40 of the head 26. Preferably, the threaded portion 50 of the bore 34 is ⅝" in diameter and has 18 threads per inch. The putter 20 further includes a rotatable member 52 generally comprising a stem portion 54 extending from a ball portion 56. Preferably, the ball portion 56 has a 9/16" diameter and the stem portion 54 has a 21/64" diameter. It should be understood that the ball portion 56 of the rotatable member 52 could also be cylindrical rather than spherical. The putter 20 further includes a ball joint seat or retainer 60 which is preferably generally a resilient plastic disk. Again, Delrin may be used. The putter 20 further includes a threaded locking member 62 such as a set screw 62.

As can be seen in FIG. 3, the ball portion 56 of the rotatable member 52 is rotatably disposed within a midportion 64 of the bore 34. The stem portion 54 of the rotatable member 52 extends through the upper portion 36 of the bore 34 and protrudes above the upper surface 25 of the head 26, where it is inserted into the shaft 22. The upper portion 36 of the bore 34 is longitudinally elongated towards one longitudinal end 3 of the head 26. The upper portion 36 of the bore 34 includes a vertical first abutment surface 67 at one longitudinal end of said upper portion 36 and a sloped second abutment surface 68 at the opposite longitudinal end of said upper portion 36. The ball portion 56 of the rotatable member 52 is retained within the midportion 64 of the bore 34 by a shoulder 70 formed in the upper portion 36 of the bore 34. A concave face 71 of the ball joint retainer 60 frictionally engages the ball portion 56 of the rotatable member 52. The retainer 60 can be loosened or tightened by the threaded locking member 62 which is threaded into the threaded portion 50 of the bore 34. The retainer 60 is resilient and thus holds member 52 at a selected position during putting or transport of the putter. Since retainer 60 is resilient, it allows adjustment of the position of member 52 without loosening locking member 62. Rather, a golfer can apply weight or force and the resilient retainer 60 allows adjustment. After the weight or force is removed, the retainer 60 returns to its original holding position. This feature allows a golfer to adjust the angle as by leaning on the head through the shaft, the golfer may thus tailor the angle for the individual green slope.

As can be seen in FIG. 4, upper portion 36 of the bore 34 is narrower than the midportion 64 of the bore 34. The upper portion 36 is preferably only slightly wider than the stem portion 54 of the rotatable member 52 or the shaft 22.

When adjustment of the head angle is desired a force is applied and the ball portion 56 rotates within the midportion 64 of the bore 34 on ball joint retainer 60. As mentioned above, the locking member 62 may be loosened during this adjustment but due to resilient retainer 60, this is not necessary. The stem portion 54, and therefore the shaft 22 of the putter 20, can pivot freely between roughly 30 degrees and 90 degrees relative to the axis of the head 26. At roughly 90 degrees, the shaft 22 abuts the first abutment surface 67 in the upper portion 36 of the bore 34. At roughly 30 degrees, the shaft 22 abuts the second abutment surface 68 in the upper portion 36 of the bore 34. The narrower upper portion 36 acts as a guide, preventing pivotal movement of the shaft 22 about the axis of the head 26. After moving the shaft 22 to the desired angle relative to the axis of the head 26, the golfer releases the force. If locking member 62 has been loosened, it is again tightened.

The shaft 22 is prevented from pivoting about the axis of the head 26 by the upper elongated portion 36 of the bore 34. Further, the convex faces 32 ensure that proper line contact with thee golf ball 46 will occur even if the golfer slightly rotates the shaft 22 about the axis of the head 26. Because the head 26 includes convex faces 32 on both sides of the head 26, the putter 20 can be used by both right-handed and left-handed golfers.

As can be seen in FIG. 5, an alternative putter 80 according to the present invention includes an offset shaft 82 pivotally secured to the head 26.

As can be seen in FIG. 6, another alternative putter 90 according to the present invention includes a shaft 22 pivotally secured to an alternative head 92 having a pair of flat faces 94.

FIG. 7 shows another embodiment 100 of a putter. The head 102 receives a shaft 104 at a side. As shown, the shaft 104 can pivot to an adjusted position such as position 106, shown in phantom.

As shown in FIG. 8, the head 102 has an end bore 108. A guide plug 110 fits within bore 108. A guide channel 112 is formed within plug 110 and an opening 114 extends to channel 112 through the guide plug 110.

An inner end 116 of the shaft 104 extends into channel 112. A pin 118 is fixed within a hole 120 in inner end 116. Pin 118 pivots within guide channel 112. At the same time, inner end 116 is supported within hole 114, and a matching hole 121 on the other side of the plug 110.

Locking pins extend through holes 124 in the top of the putter head 102. Locking pins 126 are preferably formed with a hex nut on the top, such that they may be threadably moved inwardly or outwardly of the head 102.

As shown in FIG. 9, the threaded locking members 126 extend through holes 124, and abut the pin 118. The shaft 104 is moved to a desired position with the threaded locking member 126 removed outwardly of the head 102 from this position. Once the shaft is in a desired position, the two threaded member 126 are turned into the holes 124 to abut the pin 118. Since there are threaded locking members on both sides of the pivot axis of the pin 118 (i.e., the portion 116) the pin 118 is thus locked at the desired position.

As shown in FIG. 10, should it be desired to change the position of the shaft 106, the threaded locking members can be merely moved outwardly to again allow adjustment. Once the shaft is at its desired position, the threaded locking members are again driven inwardly to lock the shaft 104.

In accordance with the provisions of the patent statutes, the present invention has been described in what is considered to represent its preferred embodiment. However, it should be noted that the invention can be practiced otherwise than as specifically illustrated and described without departing from its spirit or scope.

I claim:

1. A putter comprising:

a head having an opening in a side wall;

a shaft having an outer portion to be gripped by a golfer, and an inner end portion extending generally perpendicularly to said outer portion, and into said opening in said side wall of said putter;

a locking structure including a pin received in said inner end portion of said shaft, said inner input portion pivoting about a central axis in said opening and within said head, to adjust the angular position of said outer portion and locking members for locking said pin once a desired adjusted position of said shaft relative to said head is achieved.

2. A golf club comprising:

a head having an opening in a side wall;

a shaft having an inner end portion extending into said opening in said side wall of said putter:

a locking structure including a pin received in said inner end portion of said shaft, and within said head, and locking members for locking said pin once a desired, adjusted position of said shaft relative to said head is achieved; and said locking members include two threaded members arranged on each side of a pivot axis of said inner end portion, said threaded locking members abutting and locking said pin which rotates with said inner portion of said shaft.

3. A golf club as recited in claim 2, wherein said head includes a central bore, and said pin rotates within said bore, said threaded locking members moving into said bore to lock said pin.

4. A golf club as recited in claim 3, wherein a guide plug is received within said bore, said pin rotating within a guide channel formed in said guide plug, and said inner end portion being guided between opposed walls of said guide plug.

* * * * *